US005699856A

United States Patent [19]

Merle

[11] Patent Number: 5,699,856

[45] Date of Patent: Dec. 23, 1997

[54] BANK OF PLATES FOR HEAT EXCHANGER AND METHOD OF ASSEMBLING SUCH A BANK OF PLATES

[75] Inventor: Gabriel Merle, Le Creusot, France

[73] Assignee: Packinox, Louveciennes, France

[21] Appl. No.: 523,679

[22] Filed: Sep. 5, 1995

Related U.S. Application Data

[63] Continuation of Ser. No. 64,865, May 24, 1993, abandoned.

[30] Foreign Application Priority Data

May 22, 1992 [FR] France ..... 92 06315

[51] Int. Cl.[6] ..... F28F 3/00

[52] U.S. Cl. ..... 165/166; 165/DIG. 387

[58] Field of Search ..... 165/166, DIG. 387

[56] References Cited

U.S. PATENT DOCUMENTS

| | | | |
|---|---|---|---|
| 3,831,674 | 8/1974 | Stein et al. | 165/166 |
| 3,931,854 | 1/1976 | Ivakhnenko et al. | 165/166 |
| 4,688,631 | 8/1987 | Peze et al. | 165/166 |

FOREIGN PATENT DOCUMENTS

| | | |
|---|---|---|
| 1224753 | 6/1960 | France . |
| 1507989 | 12/1967 | France . |
| 2166063 | 8/1973 | France . |
| 1007879 | 10/1965 | United Kingdom . |
| 1043224 | 9/1966 | United Kingdom . |

OTHER PUBLICATIONS

EPO 203 213.
German 2,109,308.

*Primary Examiner*—John Fox
*Attorney, Agent, or Firm*—Pollock, Vande Sande & Priddy

[57] ABSTRACT

A bank of plates for a heat exchanger, of the type comprising a stack of parallel plates each having smooth-surface edges and an undulated central portion forming, with the associated plates, a dual circuit for countercurrent flow of two independent fluids. The bank is composed of a plurality of superposed elements, each formed by a pair of plates which are joined together. The superposed elements are connected to each other via a continuous or discontinuous longitudinal weld bead.

11 Claims, 5 Drawing Sheets

FIG. 3
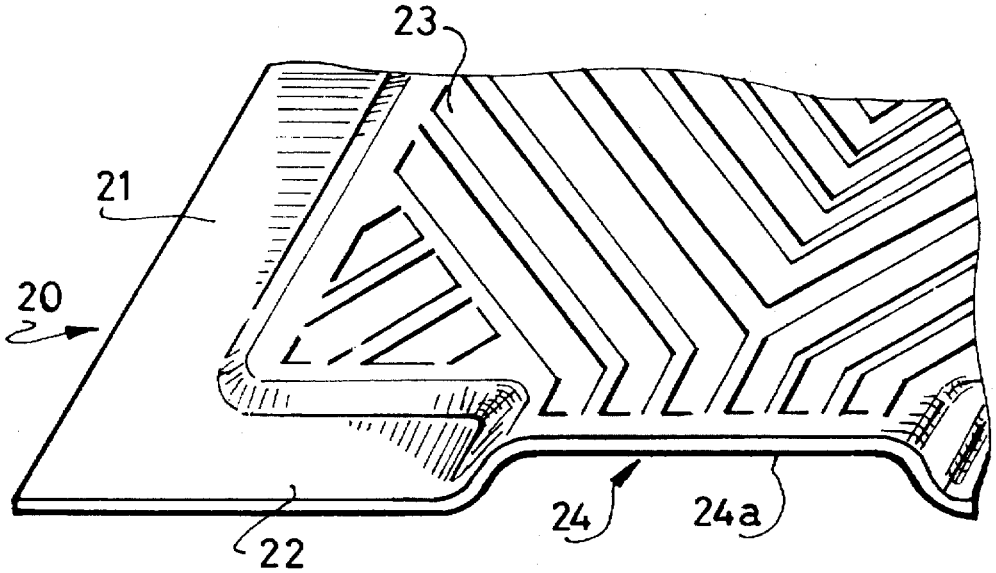
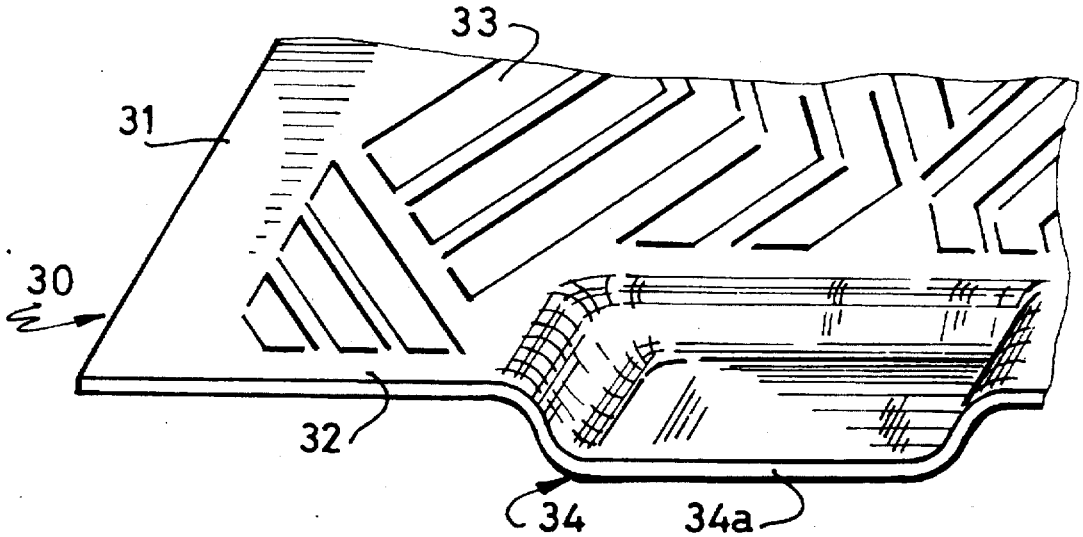
FIG. 4

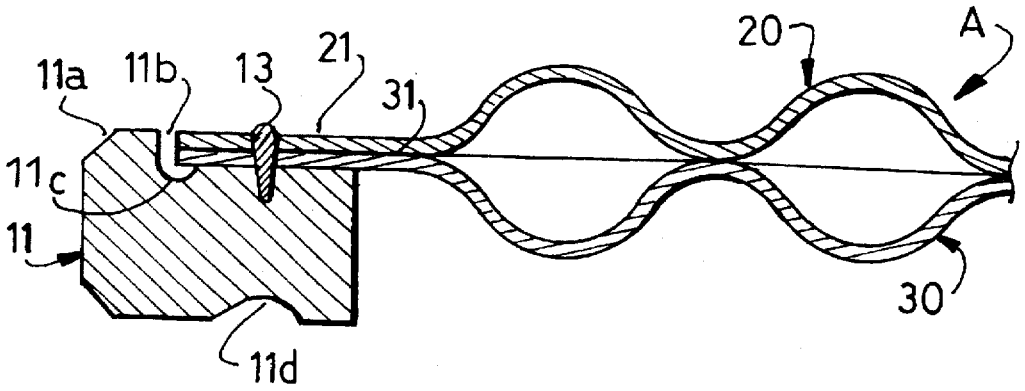
FIG. 6
FIG. 7
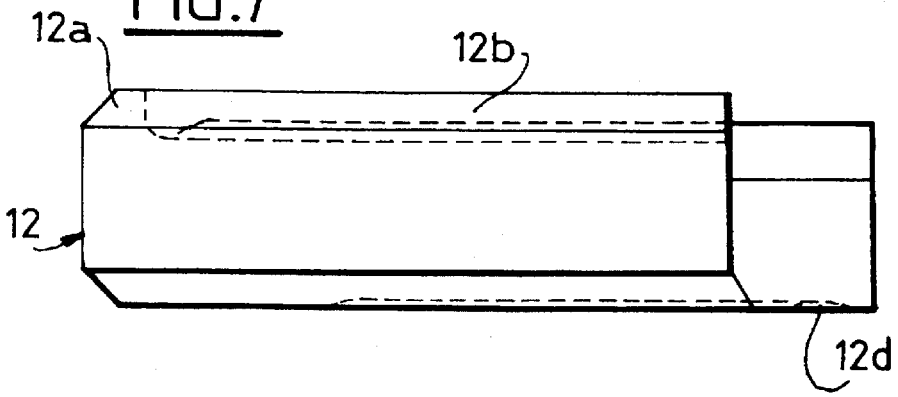
FIG. 8
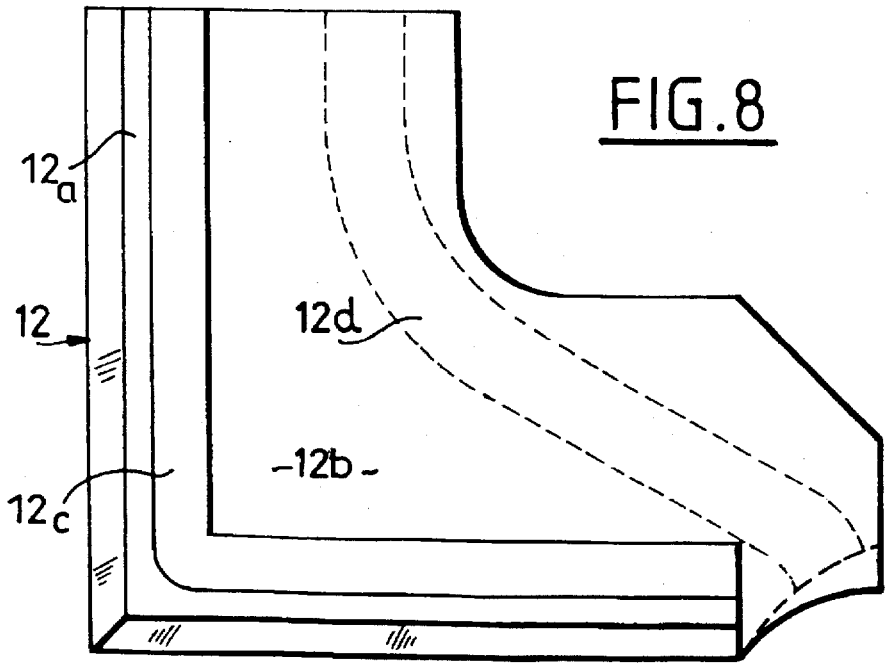

BANK OF PLATES FOR HEAT EXCHANGER AND METHOD OF ASSEMBLING SUCH A BANK OF PLATES

This application is a continuation of application Ser. No. 08/064,865 filed May 24, 1993 now abandoned.

FIELD OF THE INVENTION

The subject of the present invention is a bank of plates for a heat exchanger and a method of assembling such a bank of plates.

The invention also relates to a heat exchanger equipped with such a bank of plates.

BACKGROUND OF THE INVENTION

Heat exchangers are generally of two types.

The first type of heat exchanger includes a bank of "U"-shaped tubes or a bank of straight tubes, through which bank a fluid flows.

However, this type of exchanger is of expensive design and its thermal efficiency is limited, given that the number of tubes depends on the available space, which in most cases is restricted.

The second type of heat exchanger includes a bank of plates arranged contiguously and parallel to each other.

The plates, consisting of thin metal sheets, most often made of stainless steel, include smooth-surface edges and a central portion equipped with undulations by means of which they are in contact with each other and define a dual circuit for countercurrent flow of two independent fluids from one end of the exchanger to the other.

The plates are assembled, so as to form the bank, in the following manner.

First of all, the plates are stacked, inserting, between the longitudinal edges of each plate, a spacer-forming strip.

The longitudinal edges of the plates, being of a width sufficient to enable the ideal position of the associated strip to be determined, are squared off so as to produce, on each side of the bank, a plane and uniform vertical surface in accordance with the requirements of the subsequent welding operation.

Next, a weld layer is laid down over the entire height of each lateral surface of the bank in order to form an impermeable solder wall.

Such an embodiment of the bank requires considerable time for carrying out the welding operation and includes an operation intended to square off the longitudinal edges of the plates, which leads to waste of material.

In addition, this technique has the drawback that a leaktightness test required before use of the bank can be carried out only after assembling all the plates.

Consequently, in the event of a leak, the search for the origin of the leak is tricky and tedious, given that this search is only possible by removing zones.

SUMMARY OF THE INVENTION

It is easy to imagine the difficulties which ensue from this.

The object of the present invention is to avoid the aforementioned drawbacks by providing a plate bank which is simpler and less expensive to produce and for which the leaktightness test is made easier.

The subject of the present invention is therefore a bank of plates for a heat exchanger, of the type comprising a stack of parallel plates each including smooth-surface edges and a central portion equipped with undulations in order to form, with the associated plates, a dual circuit for countercurrent flow of two independent fluids. The bank is composed of a plurality of superposed elements, each formed by a pair of plates which are joined together, and the plates of each pair are Joined together by means for linking the superposed elements connected to each other via a continuous or discontinuous, longitudinal weld bead.

According to other preferred characteristics of the invention:

each pair A of plates is formed by an upper plate and a lower plate, the longitudinal edges of which are contiguous and the transverse edges of which include at least one contiguous portion, at least one non-contiguous portion of the transverse edges forming at least one inlet and at least one outlet for one of the fluids and the contiguous portion of the transverse edges of each plate pair forming, with the contiguous portion, pairs of plates adjacent to at least one inlet and at least one outlet for the other of the two fluids, the non-contiguous portion of each pair of plates is formed, by at least one recess provided on the transverse edges of the upper plate, and, by at least one recess provided on the transverse edges of the lower plate, the linkage means are formed by at least one longitudinal spacer arranged beneath each of the longitudinal edges of the corresponding pair of plates and by a corner cleat arranged at the corners of the pair of plates, and the longitudinal edges and the corners are fixed to the spacers and said corner cleats via a continuous weld bead extending parallel to the direction of flow of the fluids.

The subject of the present invention is also a method of assembling such a bank of plates, in which:

two plates are superposed in order to form pairs of plates, the longitudinal edges and at least one portion of the transverse edges of which are contiguous, at least one non-contiguous portion of the transverse edges forming at least one inlet and at least one outlet for one of the two fluids at least one longitudinal spacer is arranged on the lower face of the transverse edges and a corner cleat is arranged on the lower face of the corners of each pair of plates, each pair of plates is welded via a weld bead to the spacers and to the corner cleats in order to hold the plates in place, end cleats are installed at the ends of the non-contiguous portions of the transverse edges of each pair of plates, the contiguous portions of the transverse edges and the end cleats are welded to the transverse edges of the plates of each pair of plates, a leaktightness test is carried out for each pair of plates thus formed, the pairs of plates are superposed, and the longitudinal spacers and the superposed corner cleats are welded via a continuous or discontinuous weld bead.

A further subject of the present invention is also a plate heat exchanger which includes a vessel withstanding the internal pressure, in which vessel a bank of plates such as defined hereinabove is placed.

BRIEF DESCRIPTION OF THE DRAWINGS

The invention will be better understood with the aid of the description which follows, given solely by way of example and made with reference to the attached drawings, in which:

FIG. 3 is a schematic perspective view of an upper plate of a pair of plates.

FIG. 4 is a schematic perspective view of a lower plate of a pair of plates.

FIG. 6 is a partial sectional view of a pair of plates of the bank, FIG. 7 is a side view of a corner cleat of the linkage means of a pair of plates, and FIG. 8 is a plan view of a corner cleat.

DESCRIPTION OF THE PREFERRED EMBODIMENT

Figure 1:
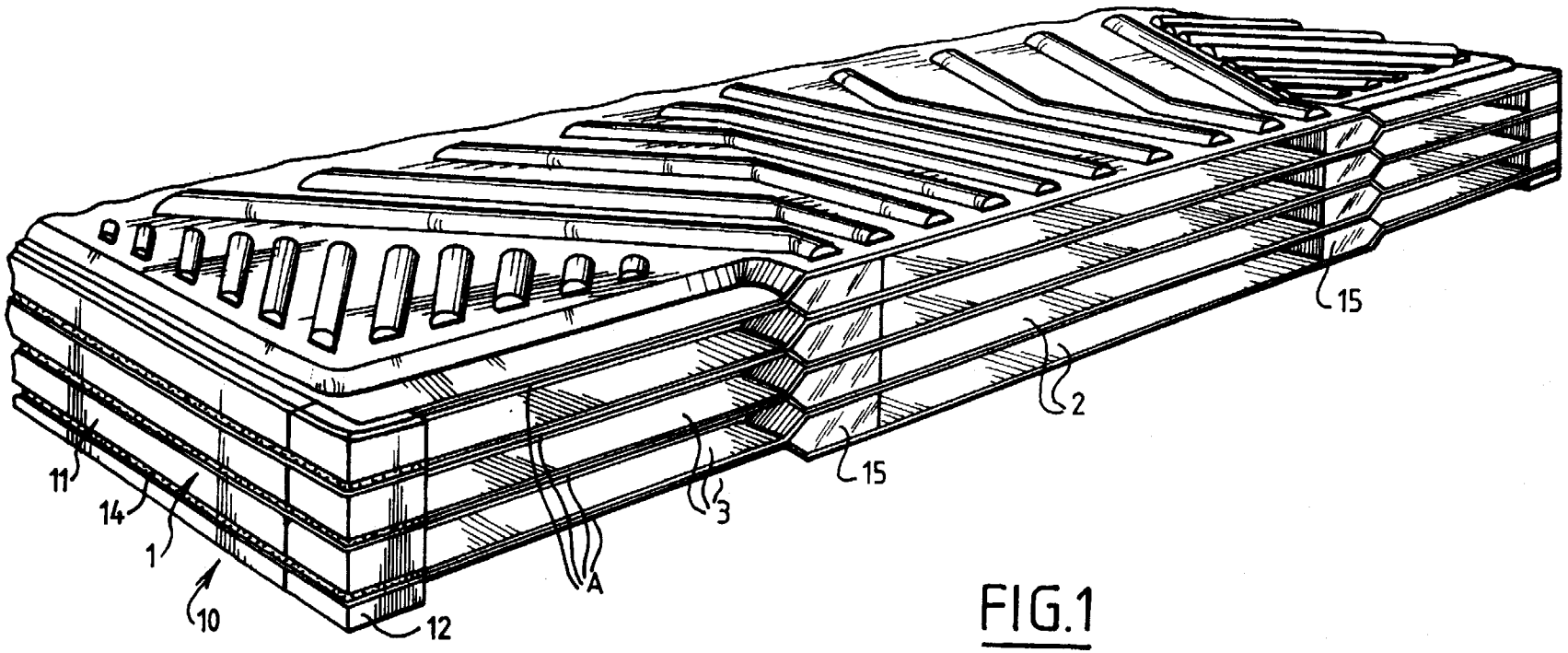
FIG. 1 is a schematic perspective view of a portion of a bank of plates according to the invention.
Figure 2:
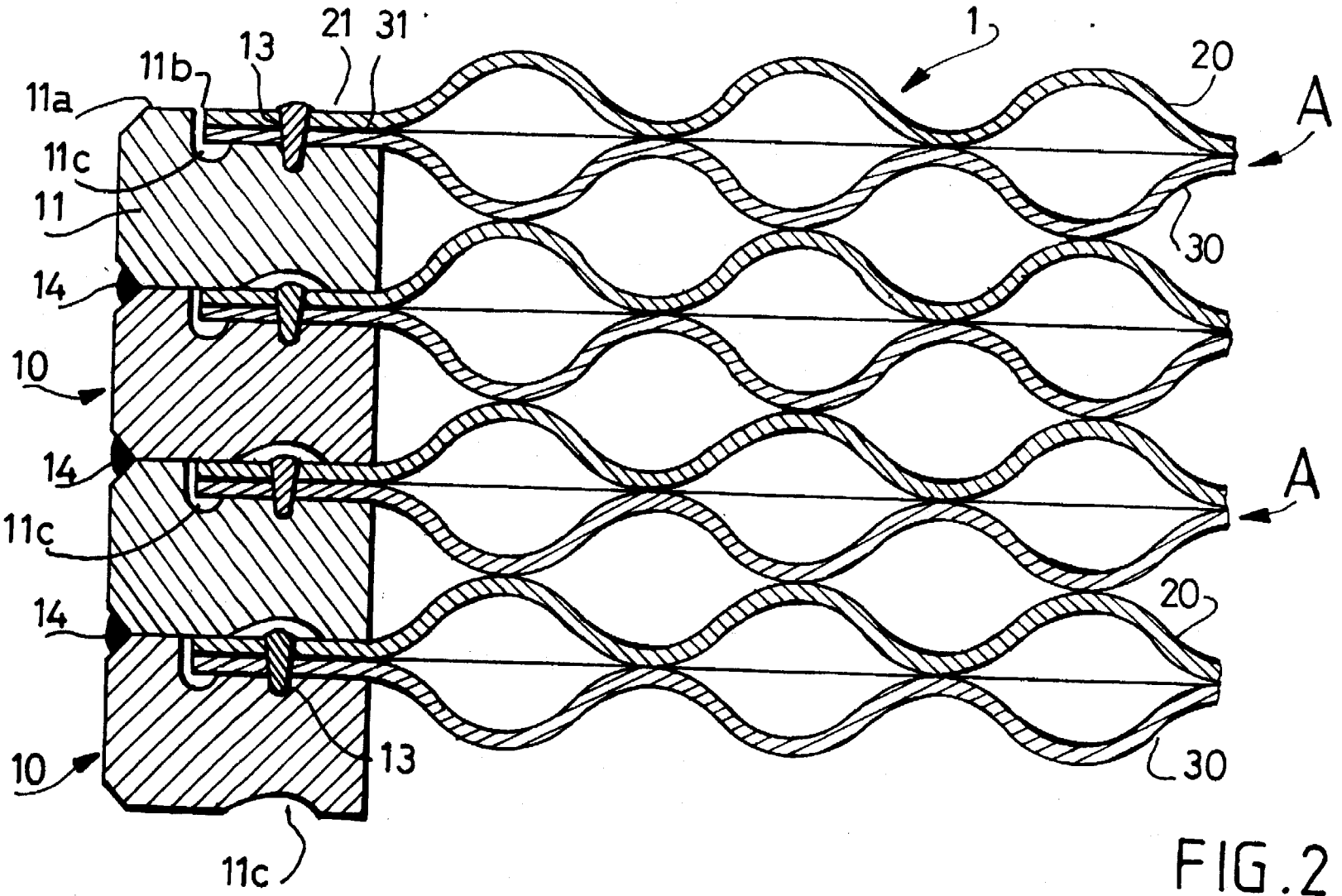
FIG. 2 is a partial cross-sectional view of the bank of plates according to the invention.

As shown in FIGS. 1 and 2, the bank 1 of plates is composed of a stack of superposed elements each formed by a pair A of parallel plates 20–30.

Each plate 20 or 30 consists of a thin metal sheet, most often made of stainless steel or any other sufficiently ductile material.

Each pair A of plates is composed of an upper plate 20 and a superposed lower plate 30.

The upper plate 20, shown in FIG. 3, includes smooth-surface transverse edges 22 and longitudinal edges 21 and a central portion equipped with undulations. The transverse edges 22 include at least one recess 24.

The longitudinal edges 21 and the portions of the transverse edges 22 which do not include recesses 24 define a first plane, while the central portion 23 and the upper face 24*a* of the recess or recesses 24 define a second plane parallel to the first plane and in relief in relation to the latter.

The lower plate 30, shown in FIG. 4, includes smooth-surface transverse edges 32 and longitudinal edges 31 and a central portion 33 equipped with undulations. The transverse edges 32 include at least one recess 34.

The longitudinal edges 31 and the portions of the transverse edges 32 which do not include recesses 34, together with the central portion 31, define a first plane, whereas the lower face 34*a* of the recess or recesses 34 defines a second plane, parallel to the first plane and inset in relation to the latter.

In order to form each pair A of plates, the plates 20–30 are superposed and bear on each other by means of their longitudinal edges 21–31 and by at least one portion of the transverse edges 22–32 which are therefore contiguous, and by means of the crests of the undulations, which forms a first circuit for a heat-exchange fluid.

According to the embodiment shown in FIGS. 1, 3 and 4, each transverse edge 22–32, of the upper plate 20 and lower plate 30 respectively, includes a recess 24–34.

The recesses 24 to 34 face each other and are oriented in opposite directions in relation to the junction plane of the plates 20–30 of the pair A of plates.

According to a preferred embodiment, the recesses 24 to 34 are located substantially in the middle of the transverse edges 22–32 of the plates 20–30.

As shown in FIG. 1, the recesses 24–34 delimit, at one end of the bank 1, an inlet 2 and, at the opposite end, an outlet for the first heat-exchange fluid.

The pairs A of plates are superposed and bear on each other, especially by means of the crests of the undulations of the adjacent plates 20–30, thus forming a second circuit for another heat-exchange fluid.

As shown in FIG. 1, the contiguous portions of the transverse edges 22–32 of each pair A of plates form, with the contiguous portions of the adjacent pairs A of plates, at one end of the bank 1, at least one inlet and, at the opposite end of said bank 1, at least one outlet for the second heat-exchange fluid.

The heat-exchange fluids flow, in a countercurrent manner, longitudinally from one end of the bank 1 to the other.

The plates 20–30 of each pair A and the pairs A of plates are joined together by linkage means 10.

These linkage means 10, shown in more detail in FIGS. 2 and 5 to 8, comprise by at least two longitudinal spacers 11 each arranged beneath the longitudinal edges 21–31 of the pair A of plates, and by four corner cleats 12 each arranged at a corner of the pair of plates.

The longitudinal spacers 11 and the corner cleats 12 have a thickness corresponding to the gap between the adjacent pairs A of plates.

The upper face of each longitudinal spacer 11 includes an outer rim 11*a* delimiting a housing 11*b* intended to receive the longitudinal edges 21–31 of the associated pair A of plates and of a depth substantially equal to the thickness of the plates 20–30 of said pair of plates.

The rim 11*a* and the housing 11*b* of each longitudinal spacer 11 extend over the entire length of the spacer.

The outer rim 11*a* has a height substantially equal to the thickness of the plates 20–30 of the associated pair A of plates so as to form, with the upper face of the longitudinal edge 21 of the upper plate 20 of said pair A of plates, a continuous plane bearing surface for the lower face of the spacer 11 of that pair of plates which is located above, as shown in FIG. 2.

The housing 11*b* of each spacer 11 is substantially wider than the longitudinal edges 21–31 of the plates 20–30 in order to enable the ideal position of each spacer 11 in relation to the plates 20–30 to be determined.

The housing 11*b* of each spacer 11 includes, in the vicinity of the rim 11*a*, a groove 11*c* intended to receive the possible burrs of the plates 20–30.

The plates 20–30 of each pair A of plates are fixed to the longitudinal spacers 11 by their longitudinal edges 21–31 by means of a continuous weld bead 13 parallel to the direction of flow of the heat-exchange fluids.

The lower face of each longitudinal spacer 11 includes a groove 11*d* extending over the entire length of the spacer for the positioning of the in-relief portion of the weld bead 13 of that pair A of plates which is located below (FIGS. 2 and 6).

Figure 5:
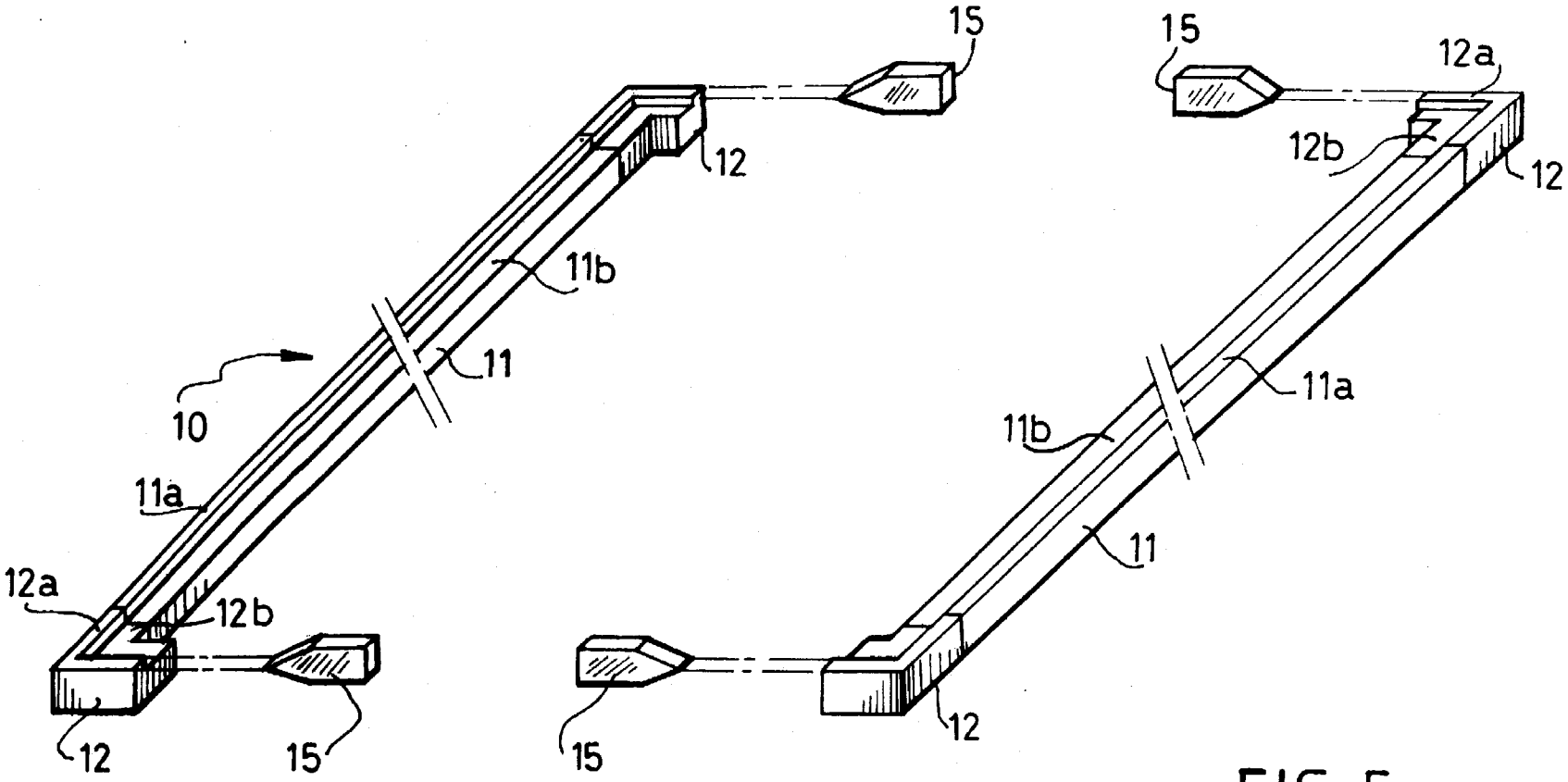
FIG. 5 is a schematic perspective view of the linkage means and of the end cleats of a pair of plates of the bank.

As shown in FIGS. 5, 7 and 8, each corner cleat 12 is formed by two perpendicular branches and includes on its lower face an outer rim 12*a* delimiting a housing 12*b* intended to receive the corner of the associated pair A of plates and of a depth substantially equal to the thickness of the plates 20–30 of the pair of plates.

The housing 12*b* of each corner cleat 12 is substantially wider than the edges of the plates 20–30 so as to enable the ideal position of each corner cleat 12 in relation to the longitudinal spacers 11 and to the plates 20–30 to be determined.

The outer rim 12*a* of each corner cleat 12 has a height substantially equal to the thickness of the plates 20–30 of the associated pair A of plates so as to form, with the upper face of the upper plate 20, a plane surface.

The housing 12*b* of each corner cleat 2 includes, in the vicinity of the rim 12*a*, a groove 12*c* intended to receive the possible burrs of the plates 20–30.

The plates 20–30 of each pair A of plates are also fixed to the corner cleats 12 by their corners, by means of the continuous weld bead 13.

The lower face of each corner cleat 12 includes a groove 12*d* (FIGS. 7 and 8) for the positioning of the in-relief portion of the weld bead 13 of that pair A of plates which is located below.

Moreover, the contiguous portions of the transverse edges 22–32 of the plates 20–30 of each pair A of plates are connected together by means of a weld bead (not shown), in order to produce, with the weld bead 13, a seal between the plates 20–30 of each pair A of plates.

The pairs A of plates, each equipped with longitudinal spacers 11 and with corner cleats 12, are superposed and fixed to each other by means of a continuous or discontinuous weld bead 14 laid down from the outside and at the junction plane of the spacers and the corner cleats.

Each end of the non-contiguous portion formed by the recesses 24–34 of the transverse edges 22–32 of each pair A of plates is provided with an end cleat 15 (FIG. 5) connected to the plates 20–30 by means of a weld bead (not shown).

The height of each end cleat 15 is substantially equal to the height of the gap between the upper face 24*a* of the recess 24 and the lower face 34*a* of the recess 34.

The longitudinal spacers 11, the corner cleats 12 and the end cleats 15 are made from a material compatible with the material constituting the plates 20–30, for example stainless steel.

The assembly of the bank 1 of plates according to the present invention is carried out in the following manner.

First of all, two plates 20–30 are superposed in such a way that the longitudinal edges 21–31 and the portions of the transverse edges which do not include recesses 24–34 are contiguous.

The pair A of plates thus produced is placed on two longitudinal spacers 11 and on four corner cleats 12 so that the longitudinal edges 21–31 and the corners of this pair A of plates is positioned in the housings 11*b* and 12*b* respectively.

The pair A of plates is fixed to the longitudinal spacers 11 and the corner cleats 12 by means of the continuous weld bead 13 in order to produce a mechanical linkage at the interface comprising the plates 20–30, the spacers 11 and the corner cleats 12.

Next, the end cleats 15 are arranged at the ends of the non-contiguous portions of the transverse edges 22–32.

The contiguous portions of the transverse edges 22–32 are welded together and the end cleats 15 are welded to the transverse edges 22–32 of the plates 20–30.

Each pair A of plates is produced in an identical manner.

After completing these various operations, each pair A of plates is subjected to a leaktightness test which makes possible interventive operations easier to perform in the case of the detection of a leak.

The pairs A of plates are superposed and the longitudinal spacers 11 and the corner cleats 12 located on top of each other are welded to each other by means of a continuous or discontinuous weld bead 14 so as to render the whole assembly integral.

The bank of plates thus formed is placed in a vessel (not shown) which withstands the internal pressure so as to constitute a heat exchanger.

This type of head exchanger may operate, for example, up to temperatures of 600° C. and above and, for example, up to and above 200 bar.

Such a bank, which requires neither an operation to square off the edges of the plates nor an operation for welding the whole of the bank on its lateral edges, therefore has the advantage of being easier to assemble and thereby less expensive, while still possessing a level of quality meeting the most stringent standards.

I claim:

1. A bank of plates for a heat exchanger, said bank comprising a plurality of superposed elements each formed by a pair of parallel plates, each said pair including an upper plate and a lower plate having contiguous longitudinal edges and transverse edges including at least one contiguous portion, each of said parallel plates including an undulated central portion so as to form, with an associated plate of a said pair of parallel plates, a circuit for current flow of a first fluid, an adjacent pair of parallel plates forming a circuit for countercurrent flow of a second fluid, said superposed elements each formed by a pair of parallel plates being linked to each other by at least one longitudinal spacer arranged between said longitudinal edges of adjacent superposed elements formed by a pair of plates and by a corner cleat arranged at corners of said adjacent superposed elements formed by a pair of plates, said longitudinal edges and said corners of each said pair of plates being fixed to said spacers and said corner cleats by a continuous weld bead extending parallel to a direction of flow of said first and second fluids.

2. Bank of plates according to claim 1, wherein said longitudinal spacers and said corner cleats have a thickness corresponding to a gap between two pairs of adjacent plates.

3. Bank of plates according to claim 1, wherein an upper face of each longitudinal spacer includes an outer rim delimiting a housing intended to receive said longitudinal edges of a superposed element formed by an associated pair of plates and has a thickness substantially equal to a thickness of the plates of said pair of plates, said rim and said housing extending over the entire length of said spacer.

4. Bank of plates according to claim 3, wherein said outer rim has a height substantially equal to the thickness of said plates of said associated pair of plates in order to form, with the upper face of said longitudinal edges of said pair of plates, a plane surface.

5. Bank of plates according to claim 3, wherein said housing of each longitudinal spacer includes, in the vicinity of said rim, a groove intended to receive possible burrs of said plates.

6. Bank of plates according to claim 1, wherein a lower face of each spacer includes a groove extending over the entire length of said spacer for positioning an in-relief portion of said weld bead of the adjacent pair of plates.

7. Bank of plates according to claim 1, wherein each corner cleat is formed by two perpendicular branches and includes an upper face with an outer rim delimiting a housing intended to receive the corner of said associated pair of plates and of a thickness substantially equal to a thickness of said plates of said pair of plates.

8. Bank of plates according to claim 7, wherein said outer rim has a height substantially equal to the thickness of the plates of said associated pair of plates in order to form, with the upper face of said longitudinal edges, a plane surface.

9. Bank of plates according to claim 7, wherein a housing of each corner cleat includes, in the vicinity of said outer rim, a groove intended to receive possible burrs of said plates.

10. Bank of plates according to claim 1, wherein a lower face of each corner cleat includes a groove for positioning the in-relief portion of said weld bead of an adjacent pair of plates.

11. Bank of plates according to claim 1, wherein each end of said non-contiguous portions of said transverse edges of each pair of plates is provided with an end cleat connected to said plates by a weld bead.

* * * * *